United States Patent [19]

Espy

[11] 4,331,474

[45] May 25, 1982

[54] FERRITIC STAINLESS STEEL HAVING TOUGHNESS AND WELDABILITY

[75] Inventor: Ronald H. Espy, West Chester, Ohio

[73] Assignee: Armco Inc., Cincinnati, Ohio

[21] Appl. No.: 190,364

[22] Filed: Sep. 24, 1980

[51] Int. Cl.[3] ..... C22C 38/26; C22C 38/48

[52] U.S. Cl. ..... 75/124; 75/126 F; 75/128 G; 148/37

[58] Field of Search ..... 75/124, 126 C, 128 G, 75/128 T, 128 A, 126 F, 126 J, 128 N, 125; 148/37

[56] References Cited

U.S. PATENT DOCUMENTS

| | | | |
|---|---|---|---|
| 3,658,514 | 4/1972 | Lula et al. | 75/128 T |
| 3,840,366 | 10/1974 | Hirayama et al. | 75/128 G X |
| 3,856,515 | 12/1974 | Brandis et al. | 75/126 C |
| 3,865,644 | 2/1975 | Hellner et al. | 75/128 G X |
| 3,925,064 | 12/1975 | Takamura et al. | 75/128 A |
| 3,926,685 | 12/1975 | Gueussier et al. | 148/37 X |
| 3,957,544 | 5/1976 | Pinnow et al. | 75/128 G X |
| 4,119,765 | 10/1978 | Pinnow et al. | 75/128 N X |
| 4,155,752 | 5/1979 | Oppenheim et al. | 75/124 |
| 4,255,497 | 3/1981 | Bond et al. | 75/128 N X |

FOREIGN PATENT DOCUMENTS

| | | | |
|---|---|---|---|
| 54-112718 | 9/1979 | Japan | 75/128 G |

*Primary Examiner*—Peter K. Skiff
*Attorney, Agent, or Firm*—Frost & Jacobs

[57] ABSTRACT

A ferritic stainless steel containing 0.03% maximum carbon, up to about 12% manganese, about 0.03% maximum phosphorus, about 0.030% maximum sulfur, about 1.0% maximum silicon, about 12% to about 26% chromium, about 5% maximum nickel, 0.10% to 0.5% aluminum, 0.2% to 0.45% columbium, 0.03% maximum nitrogen, about 2% maximum copper, about 5% maximum molybdenum, residual titanium, and balance essentially iron. Columbium is present in excess of the amount required to react completely with carbon. The steel has high ductility and toughness in heavy sections and good corrosion resistance in weld areas.

8 Claims, No Drawings

FERRITIC STAINLESS STEEL HAVING TOUGHNESS AND WELDABILITY

BRIEF SUMMARY OF THE INVENTION

This invention relates to a ferritic stainless steel exhibiting improved toughness, good weldability, improved corrosion resistance in the heat affected zone of a weldment and good ductility over a wide range of chromium contents. Moreover, the steel of the invention exhibits this desired combination of properties in hot rolled plate form having a thickness greater than 3.2 mm and in hot reduced bar form having diameters up to about 3.2 cm, by reason of critical balancing of alloying ingredients and heat treatment within a temperature range of about 900° to about 1125° C.

Ferritic stainless steels have traditionally been inferior to austenitic stainless steels in weldability. In general, ferritic steels exhibit low ductility and toughness and reduced resistance to corrosion in the heat affected zone of a weldment. Additionally, the toughness of the ferritic base metal in heavy sections is frequently deficient. These problems tend to become more significant as the chromium content of the steel is increased.

The conventional approach of annealing subsequent to welding is effective in correcting weld area problems, but this increases cost and is not practicable in the case of large welded articles having heavy welded sections. It is therefore desirable to be able to use welded articles or components in their as-welded condition.

Heat treatment of ferritic chromium stainless steels has conventionally been conducted in a different manner from that of the austenitic chromium-nickel stainless steels. Moreover, the heat treatment of ferritic stainless steels has been generally limited to light section product forms such as sheet, strip and wire.

In the heat treatment of austenitic stainless steel sheet and strip continuous short time anneals dominate. In the heat treatment of austenitic stainless steel wire, batch anneals dominate. In both instances the annealing temperature for austenitic stainless steels ranges from about 900° to about 1125° C., preferably about 1035° to about 1065° C.

In contrast to this, the heat treatment of ferritic stainless steels has conventionally been conducted within the temperature range of about 760° to about 870° C., generally as a batch anneal of substantial length regardless of product form.

It is a particular advantage of the present invention that the ferritic stainless steel of modified composition can be subjected to heat treatment very similar to those used for chromium-nickel austenitic stainless steels, thereby substantially shortening heat treatment time with consequent reduction in processing cost and increased availability of furnace time. Morever, the short time heat treatment applied to the modified ferritic stainless steel of this invention can be applied to heavy section product forms both in the form of plate and in the form of bar and wire. In some chromium ranges the short time, high temperature heat treatment results in greater toughness than the conventional heat treatment applied to ferritic stainless steels.

The novel and unexpected improvements in properties obtained by steels of the invention are exhibited throughout a chromium range of about 12% to about 26% by weight, and result from addition of aluminum and columbium within relatively narrow and critical ranges, and control of the maximum carbon and nitrogen contents, with columbium being present in excess of the amount required to react completely with carbon.

U.S. Pat. No. 4,155,172, issued May 22, 1979 to R. Oppenheim et al, discloses a ferritic stainless steel containing chromium, nickel and molybdenum, with required additions of columbium (niobium), zirconium and aluminum and optional addition of titanium. In broad ranges, the steel of this patent contains 18% to 32% chromium, 0.1% to 6% molybdenum, 0.5% to 5% nickel, 0.01% to 0.05% carbon, 0.02% to 0.08% nitrogen, 0.10% to 0.60% columbium, 0.005% to 0.50% zirconium, 0.01% to 0.25% aluminum, up to 0.25% titanium, up to 3% each copper and silicon, up to 1% manganese, up to 0.01% each calcium, magnesium, cerium or boron, and remainder iron.

In this patent the sum of carbon plus nitrogen must be greater than 0.04%; a minimum of 0.5% nickel is required; columbium must be at least 12 times the carbon content; and total zirconium and 3.5 times the aluminum content must be at least 10 times the free nitrogen.

Despite the broad maximum of 0.25% aluminum disclosed in this patent, it is stated at column 5, lines 26–40, that a maximum of 0.10% aluminum is critical in order to obtain good intercrystalline corrosion resistance. At column 5, lines 47–56, it is alleged that with carbon plus nitrogen above about 0.040% and up to at least 0.080% the stable binding of carbon and nitrogen is not possible by columbium plus zirconium or columbium plus aluminum. Rather, carbon is bound by columbium and nitrogen is bound primarily by zirconium and additionally by aluminum up to a maximum of 0.1% aluminum. The addition of zirconium, which is matched to the nitrogen content of the steel, is stated to form a large number of small particles of zirconium nitrides which provide insensitivity to large-grain embrittlement at high temperatures, thereby improving the properties of the heat affected zone of a weldment (column 6, lines 49–57).

U.S. Pat. No. 4,155,752 refers to a number of prior art disclosures such as German Pat. No. 974,555, "Neue Huette", 18 (1973) pages 693–699 and German DAS No. 2,124,391. This prior art is summarized at column 2, lines 27–37 of U.S. Pat. No. 4,155,752 with the statement that highly alloyed ferritic chromium and chromium-molybdenum steels with good mechanical properties and corrosion resistance can contain carbon plus nitrogen contents greater than about 0.01% only if these greater contents are bound stably by titanium, columbium, zirconium or the like and, in the case of nitrogen, by aluminum, and if sufficient cold strength is ensured by a further limited addition of nickel.

U.S. Pat. Nos. 3,607,237 and 3,607,246 disclose the addition of aluminum and titanium to a ferritic stainless steel.

U.S. Pat. No. 3,672,876 discloses the addition of aluminum and vanadium to a ferritic stainless steel.

U.S. Pat. No. 3,719,475 discloses the addition of aluminum, titanium and vanadium to a ferritic stainless steel.

While the prior art is thus replete with disclosures relating to alloying additions for control of carbon and nitrogen in ferritic stainless steels for the purpose of improving weldability and maintaining toughness and ductility, there appears to be no recognition of the concept of controlling the sum of carbon plus nitrogen to a maximum of 0.05%, adding aluminum in an amount greater than 0.10% to form aluminum nitrides with consequent improved toughness, and adding columbium in an amount greater than that needed to combine completely with carbon, with uncombined columbium contributing to corrosion resistance in a weld area.

It is a principal object of the present invention to provide a ferritic stainless steel ranging from about 12% to about 26% chromium with aluminum and columbium additions which provide good toughness, good weldability and good corrosion resistance.

It is a further object of the invention to provide a heat treatment for a ferritic stainless steel of the above composition which provides improved toughness and strength, particularly in heavy sections.

DETAILED DESCRIPTION

A ferritic stainless steel in accordance with the present invention having high ductility and toughness in sections greater than about 3.2 mm in thickness and good corrosion resistance in the heat affected zone of a weldment consists essentially of, in weight percent, 0.03% maximum carbon, up to about 12% manganese, about 0.03% maximum phosphorus, about 0.030% maximum sulfur, about 1.0% maximum silicon, about 12% to about 26% chromium, about 5% maximum nickel, 0.10% to 0.5% aluminum, 0.2% to 0.45% columbium, 0.03% maximum nitrogen, about 2% maximum copper, about 5% maximum molybdenum, residual titanium, and balance essentially iron, with the sum of carbon plus nitrogen not exceeding 0.05%, and columbium present in excess of the amount required to react completely with carbon.

A maximum of 0.03% carbon, and preferably 0.02% maximum, should be observed for optimum corrosion resistance and in order to minimize the amount of columbium needed to stabilize the carbon. An adequate level of uncombined columbium is assured if carbon is limited to a maximum of 0.03% and preferably to a maximum of 0.02%.

Manganese preferably is maintained at a level less than about 2% for optimum toughness since it has been found that amounts in excess of about 2% or 2.5% adversely affect toughness, at least in the chromium range of about 18% to about 21%. However, manganese acts as a solid solution strengthener, and a 6% manganese addition will increase the 0.2% yield strength of a nominal 16% chromium ferritic stainless steel by about 20 ksi. Hence manganese additions up to about 12% by weight are within the scope of the present invention where maximum toughness is not required. Chromium is present for its usual functions of corrosion resistance and ferrite forming potential, and it is a significant feature of the present invention that the novel combination of properties can be obtained throughout the chromium range of AISI types 410, 430, 442 and 446.

Nickel is an optional element which may be added in amounts up to about 5% for improved toughness and corrosion resistance, provided the alloy is balanced to have a fully ferritic structure after heat treatment.

A minimum of 0.10% aluminum is essential to combine with nitrogen and provide toughness. A minimum of about 0.15% aluminum is preferred while a broad maximum of 0.5% and preferably 0.4% should be observed for optimum properties. It will of course be recognized that aluminum in excess of that required to react with nitrogen will also react with oxygen present in the steel, and the binding of oxygen in this manner may also improve toughness.

A broad columbium range of 0.2% to 0.45%, and preferably about 0.25% to 0.40%, is essential at the permissible carbon levels of the present steel in order to combine fully with the carbon and provide sufficient uncombined columbium to maintain corrosion resistance in weld areas. The maximum of 0.45% is critical since amounts in excess of this value decrease toughness.

A maximum of 0.03% nitrogen and preferably about 0.025% maximum must be observed, and the sum of carbon plus nitrogen should not exceed 0.05%, in order to avoid formation of excessive amounts of aluminum nitride. Since aluminum nitride particles are relatively large in comparison to zirconium nitride particles required in U.S. Pat. No. 4,155,752, a different mechanism is involved in the present steel, and a relatively small volume fraction of aluminum nitrides is effective in obtaining good toughness.

Up to about 2% copper may be added for solid solution strengthening and precipitation hardening if desired. Up to about 5% molybdenum may be added for improved corrosion resistance and higher strength.

Titanium should be maintained at residual levels since it adversely affects toughness.

Phosphorus, sulfur and silicon may be present in their usual residual levels without adverse effect.

As indicated above, prior art ferritic stainless steels generally exhibit low ductility and toughness and reduced corrosion resistance in the heat affected zone of a weldment. More specifically, at about 12% chromium low weld deposit ductility can be a problem. At chromium levels ranging from about 17% to 21% ductility and corrosion resistance are reduced to a low level in the heat affected zone. An increase in the chromium content to about 25% results in an improvement in ductility in the weld area, but corrosion resistance is still low.

It has been found that the steel of the present invention exhibits a significant improvement in mechanical properties, particularly toughness, and maintains adequate corrosion resistance, in comparison to conventional ferritic stainless steels now available.

Heats of steels in accordance with the invention have been prepared and compared with a series of similar steels having one or more elements outside the critical ranges of the invention and with a conventional 17% chromium (Type 430) ferritic stainless steel. The compositions of these steels are set forth in Table I.

The compositions of Table I were induction melted in air and cast in ingots. Ingots of Heats 1, 2, 6 and 7 were hot rolled from 1205° C. to 2.54 mm thickness, and mechanical properties of the hot roller material are shown in Table II. Samples were then descaled and cold reduced to 1.27 mm thickness. Tensile blanks were annealed at 927° C. and 1120° C., and mechanical properties are summarized in Table III. Samples from Heats 3–5 were forged from 1120° C. to 31.75 mm diameter bars. Each bar was hot swaged from 1120° C. to 25.4 mm diameter. Samples from Heats 8–11 were forged from 1120° C. to 31.75 mm diameter bars. Each bar was hot swaged from 1120° to 28.58 mm diameter. The bars of Heats 3–5 and 8–11 were heat treated under two conditions and machined for tests on mechanical properties and welds. The two conditions of heat treatment were:

Condition A; 788° C.; 4 hours; air cooled.

Condition H; 788° C.; 4 hours; air cooled + 1038° C.; 15 min.; water quenched.

Samples of Heats 1, 2, 6 and 7 in the hot rolled condition (2.54 mm thickness) were evaluated by sheet Charpy tests for transition temperature, which is a measure of toughness. The results, including 1000 W/A (in-lbs/in$^2$) transition temperatures, are set forth in Table IV.

Bar samples of 25.4 mm diameter of Heats 3, 4 and 5, and bar samples of 28.58 mm diameter of Heats 8 through 11 were tested for mechanical properties, including Charpy V-notch toughness at room temperature, after both the Condition A and Condition H heat treatments described above. The test data are set forth in Table V.

Bar samples of Heats 4 and 5 (of 25.4 mm diameter) and of Heats 8–11 (of 28.58 mm diameter) were welded and sectioned for corrosion tests. The welds were autogenous, using the TIG process with a helium gas shield. Weld travel speeds were 12 ipm (30.48 cm per minute) using a current of 170 amperes at 16 volts. Test specimens were examined after test at magnifications up to 30× and rated for location of corrosive attack. Results are summarized in Table VI.

As welded hot swaged bar samples of Heats 3, 4 and 5 (25.4 mm diameter) and of Heats 8, 9, 10 and 11 (28.58 mm diameter) were sectioned longitudinally to provide half-round specimens of 4.76 mm thickness. These specimens were subjected to longitudinal face guided bend tests in the as welded condition and after exposure to the copper sulfate corrosion test of ASTM A393. These test results are summarized in Table VII, the data showing the bend angle to failure in each condition.

It is evident from Table I that Heat 4 has an aluminum content below the minimum of 0.10% and a nitrogen content above the maximum of 0.03% of the steel of the present invention. Heat 5, with an aluminum content of 0.09% and a nitrogen content of 0.035%, is just below and just above, respectively, the prescribed ranges of the steel of the invention, but the standard analytical tolerances for aluminum and nitrogen at these levels would make Heat 5 within the defined ranges, except for the purposeful titanium addition of 0.23%, which is substantially above the residual titanium permissible in the steel of the invention. Heats 6 and 7 have columbium contents above the maximum of 0.45% of the steel of the invention, with the standard analytical tolerances applied, and Heat 7 additionally has a carbon content above the permissible maximum of 0.03% of the steel of the invention.

Heats 8, 9 and 10 have columbium contents below the minimum of 0.2% of the steel of the invention, with the standard analytical tolerance applied.

In other respects, the comparative Heats 4 through 10 fall within the percentage ranges of the steel of the invention.

Heat 11 is a standard AISI Type 430 steel containing no aluminum or columbium additions, and is included for comparative purposes.

Tables II and III indicate that the mechanical properties of steels of the invention (Heats 1 and 2) both in the hot rolled and cold reduced conditions are similar to comparative steels (Heats 6 and 7). The two annealing conditions of Table III show that ferritic steels of the invention can be subjected to a typical austenitic annealing treatment at 1120° C. without adverse effect. Heat 7, containing 0.047% carbon exhibited evidence of martensite formation when annealed at 1120° C.

Table IV shows that columbium in excess of 0.45% adversely affects toughness.

Table V, comparing a steel of the invention (Heat 3) with comparative steels, in the form of hot forged and swaged bars, exhibits good toughness when annealed under conventional ferritic stainless steel conditions (Condition A) and outstanding toughness when subjected to a typical austenitic annealing treatment (Condition H). While Heat 4, which is outside the scope of the invention by reason of its low aluminum and high nitrogen contents, exhibited high toughness after a typical austenitic annealing treatment (Condition H), this result is believed to be anomalous and inconsistent with its toughness value after a conventional ferritic anneal. Heat 4 may have had an unusually low oxygen level (although this was not determined), thus making substantially all the aluminum available to react with nitrogen, and this could account for the high toughness value for Heat 4 in Condition H. Heat 5 exhibited low toughness because of the titanium addition.

Table VI contains no data regarding steels of the invention but a comparison of Huey test results of Heats 8, 9 and 10 containing columbium below the minimum of 0.2% required for steels of the invention with Heats 4 and 5 containing 0.44% and 0.43% columbium, respectively, demonstrates the effectiveness of columbium in improving corrosion resistance of weldments in boiling nitric acid. In accordance with the theory of the present invention, namely that aluminum within the specified range confers toughness and columbium within the specified range confers corrosion resistance in a weld area, Heats 4 and 5 are believed to be representative of steels of the invention with respect to corrosion resistance of weldments, in view of the columbium contents of each. As indicated above the departures of Heats 4 and 5 from the ranges of the steel of the invention would be expected to affect toughness adversely but not Huey test results.

Table VII demonstrates the high ductility of a weldment of a steel of the invention (Heat 3) after both a typical ferritic and a typical austenitic anealing treatment.

It is evident that the steel of the invention exhibits high ductility and toughness in sections greater than about 3.2 mm in thickness together with good corrosion resistance in the heat affected zone of a weldment. Moreover, the steel of the invention can be subjected to heat treatment typical of that used for chromium-nickel austenitic stainless steels with consequent improvement in toughness, at least in the chromium range of about 11 to 12%.

The benefits of the improved properties of the steel of the invention are available in all product forms, such as sheet, strip, plate, bar, wire, castings and forgings. The steel also finds utility in the production of cold heading wires where batch anneals have conventionally been dominant. Heat treatment of wire by a cycle similar to that used for austenitic stainless steel could reduce the heat treatment time to one half the conventional ferritic heat treatment time.

TABLE I

| | Compositions - Weight Percent | | | | | | | | | |
|---|---|---|---|---|---|---|---|---|---|---|
| Heat No. | C | Mn | P | S | Si | Cr | Ni | Al | Cb | N |
| 1* | 0.028 | 0.25 | 0.005 | 0.014 | 0.38 | 12.76 | 0.25 | 0.14 | 0.26 | 0.023 |

TABLE I-continued

| Heat No. | C | Mn | P | S | Si | Cr | Ni | Al | Cb | N | |
|---|---|---|---|---|---|---|---|---|---|---|---|
| | Compositions - Weight Percent | | | | | | | | | | |
| 2* | 0.025 | 0.21 | 0.007 | 0.013 | 0.35 | 13.34 | 0.24 | 0.14 | 0.26 | 0.024 | |
| 3* | 0.022 | 0.05 | 0.003 | 0.013 | 0.33 | 11.21 | 0.17 | 0.21 | 0.38 | 0.016 | |
| 4 | 0.015 | 0.01 | 0.003 | 0.005 | 0.42 | 21.07 | 0.17 | 0.06 | 0.44 | 0.048 | |
| 5 | 0.012 | 6.16 | 0.004 | 0.006 | 0.37 | 21.11 | 0.15 | 0.09 | 0.43 | 0.035 | Ti 0.23 |
| 6 | 0.023 | 0.19 | 0.006 | 0.014 | 0.34 | 12.53 | 0.24 | 0.13 | 0.50 | 0.023 | |
| 7 | 0.047 | 0.23 | 0.007 | 0.014 | 0.33 | 12.47 | 0.25 | 0.14 | 0.49 | 0.024 | |
| 8 | 0.012 | 0.10 | 0.009 | 0.025 | 0.43 | 17.85 | 0.36 | 0.24 | 0.11 | 0.02 | |
| 9 | 0.015 | 2.85 | 0.010 | 0.025 | 0.47 | 18.47 | 0.18 | 0.32 | 0.12 | 0.02 | |
| 10 | 0.015 | 5.85 | 0.014 | 0.024 | 0.59 | 20.92 | 0.16 | 0.14 | 0.13 | 0.02 | |
| 11(T430) | 0.047 | 0.34 | 0.005 | 0.015 | 0.33 | 16.98 | 0.24 | — | — | — | |

*Steels of the invention

TABLE II

| Heat | U.T.S. ksi | U.T.S. MPa | 0.2% Y.S. ksi | 0.2% Y.S. MPa | % Elongation in 50.8 mm | Hardness Rockwell B |
|---|---|---|---|---|---|---|
| | Mechanical Properties - Hot Rolled 2.54 mm Thickness | | | | | |
| 1* | 61.8 | 426 | 46.2 | 318 | 20.2 | 82.5 |
| 2* | 74.6 | 514 | 66.1 | 456 | 9.8 | 93.0 |
| 6 | 61.2 | 423 | 48.1 | 332 | 20.5 | 83.5 |
| 7 | 68.9 | 474 | 50.3 | 346 | O.G. | 88.0 |

*Steels of the invention

TABLE III

| Heat | U.T.S. ksi | U.T.S. MPa | 0.2% Y.S. ksi | 0.2% Y.S. MPa | % Elongation in 50.8 mm | Hardness Rockwell B | ASTM Grain Size |
|---|---|---|---|---|---|---|---|
| | Mechanical Properties - Cold Reduced 1.27 mm Thickness | | | | | | |
| 1* (annealed 955° C.) | 59.1 | 408 | 35.1 | 242 | 32.0 | 68.5 | 5-6 Cent. 7-8 Surf. |
| " (annealed 1120° C.) | 61.0 | 421 | 35.2 | 243 | 29.0 | 70.0 | 7-8 |
| 2* (annealed 955° C.) | 60.6 | 418 | 34.8 | 240 | 30.8 | 71.0 | 5&7 Bonding |
| " (annealed 1120° C.) | 59.8 | 413 | 37.4 | 258 | 32.0 | 73.0 | 7-8 Center 5-6 |
| 6 (annealed 955° C.) | 59.8 | 413 | 34.2 | 236 | 31.5 | 69.0 | 7-8 |
| " (annealed 1120° C.) | 56.1 | 386 | 34.0 | 234 | 37.5 | 69.0 | 8-9 |
| 7 (annealed 955° C.) | 62.4 | 430 | 35.5 | 244 | 31.8 | 71.0 | 5&7 |
| " (annealed 1120° C.) | 71.0 | 490 | 40.2 | 278 | 21.5 | 79.0 | 8-9 Center 5-6 |

*Steels of the invention

TABLE IV

| Heat | −73° C. | −59° C. | −46+ C. | −18° C. | −4° C. | Rm.T. | 1000 W/A Transition Temp. (°C.) |
|---|---|---|---|---|---|---|---|
| | Transition Temperature − °C. Impact Energy W/A in-lbs/in$^2$ | | | | | | |
| 1 *High | 415 | 1517 | 1314 | 2390 | 2375 | 3880 | |
| Low | 234 | 940 | 1315 | 2000 | 2645 | 2360 | |
| Aver. | 324 | 1230 | 1314 | 2195 | 2510 | 3115 | −72° C. |
| 2 *High | 1695 | 597 | 1601 | 1460 | 2555 | 1900 | |
| Low | 177 | 305 | 1245 | 1030 | 1920 | 1475 | |
| Aver. | 732*** | 451 | 1423 | 1245 | 2235 | 1690 | −51° C. |
| 6 High | — | — | 331 | 1203 | 1788 | 4310 | |
| Low | — | — | 228 | 319 | 1067 | 371 | |
| Aver. | — | — | 279 | 761 | 1427 | 1994** | −12° C. |
| 7 High | — | — | 246 | 1465 | 1965 | 1440 | |
| Low | — | — | 184 | 227 | 559 | 1100 | |
| Aver. | — | — | 215 | 846 | 1165** | 1270 | −12° C. |

*Steels of the invention
**Average of 3 tests
***Average of 4 tests

TABLE V

| Heat | U.T.S. ksi | 0.2% Y.S. ksi | % Elong. 50.8mm | % Red Area | V-Notch Charpy R.T.-ft lbs |
|---|---|---|---|---|---|
| | Mechanical Properties - Hot Forged & Swaged 25.4 mm Diameter | | | | |
| 3* -Cond.A | 55 | 32 | 33 | 68 | 60 |

TABLE V-continued

| Heat | U.T.S. ksi | 0.2% Y.S. ksi | % Elong. 50.8mm | % Red Area | V-Notch Charpy R.T.-ft lbs |
|---|---|---|---|---|---|
| | Mechanical Properties - Hot Forged & Swaged 25.4 mm Diameter | | | | |
| " -Cond.H | 56 | 32 | 36 | 75 | 105 |
| 4 -Cond.A | 65 | 42 | 35 | 77 | 12 |
| " -Cond.H | 64 | 42 | 42 | 80 | 120 |
| 5 -Cond.A | 76 | 53 | 33 | 64 | 7 |
| " -Cond.H | 68 | 47 | 33 | 68 | 19 |
| 8 -Cond.A | 60 | 40 | 33 | 75 | 59 |
| " -Cond.H | 61 | 44 | 33 | 73 | 82 |
| 9 -Cond.A | 63 | 41 | 38 | 70 | 42 |
| " -Cond.H | 66 | 49 | 32 | 68 | 22 |
| 10 -Cond.A | 70 | 51 | 34 | 67 | 22 |
| " -Cond.H | 72 | 57 | 31 | 70 | 29 |
| 11 -Cond.A | 70 | 40 | 33 | 68 | 8 |
| " -Cond.H | 109 | 81 | 13 | 33 | 4 |

*Steel of the invention

TABLE VI

Corrosion of Weldments in 65% boiling $HNO_3$ (Huey test)

| Heat | | Rate (Inches per Month) (3 periods 48 hrs.each) | Weld Metal | Visual Examination Melt/870° C. Zone | 870°/427° C. Zone | Base Metal |
|---|---|---|---|---|---|---|
| 4 | -Cond.A | 0.0025 | Light corr. | Light corr. | — | Very light corr. |
| " | -Cond.H | 0.0026 | Light corr. | Light corr. | — | Very light corr. |
| 5 | -Cond.A | 0.0034 | Light corr. | Light corr. | — | Light corr. |
| " | -Cond.H | 0.0033 | Light corr. | Light corr. | — | Light corr. |
| 8 | -Cond.A | 0.0077 | Heavy corr. | Very heavy corr. | Very light corr. | Very light corr. |
| " | -Cond.H | 0.0126 | Heavy corr. | Very heavy corr. | Mod. corr. | Light corr. |
| 9 | -Cond.A | 0.0072 | Heavy corr. | Very heavy corr. | Very light corr. | Very light corr. |
| " | -Cond.H | 0.0240 | Heavy corr. | Very heavy corr. | Mod. corr. | Mod. corr. |
| 10 | -Cond.A | 0.0050 | Heavy corr. | Very heavy corr. | Very light corr. | Very light corr. |
| " | -Cond.H | 0.0098 | Heavy corr. | Very heavy corr. | Light corr. | Light corr. |
| 11 | -Cond.A | 0.0078 | Heavy corr. | Heavy corr. | Light corr. | Light corr. |
| " | -Cond.H | 0.0107 | Heavy corr. | Heavy corr. | Heavy corr. | Mod. corr. |

TABLE VII

Guided Bend Tests- 4.76 mm Thickness

| Heat | Condition | As Welded Bend Angle to Fail | $CuSO_4$ Test Bend Angle to Fail |
|---|---|---|---|
| 3* | A | 180° | Excessive general corr. |
| | H | 180° | Excessive general corr. |
| 4 | A | 180° | 180° |
| | H | 180° | 143° |
| 5 | A | 155° | 180° |
| | H | 178° | 180° |
| 8 | A | 180° | 31° |
| | H | 85° | 70° |
| 9 | A | 142° | 47° |
| | H | 70° | 21° |
| 10 | A | 68° | 8° |
| | H | 91° | 3° |
| 11 | A | 8° | 6° |
| | H | 22° | 7° |

*Steel of the invention

I claim:

1. A ferritic stainless steel having high ductility and toughness in sections greater than about 3.2 mm in thickness, and good corrosion resistance in the heat affected zone of a weldment, said steel consisting essentially of, in weight percent, 0.03% maximum carbon, up to about 12% manganese, about 0.03% maximum phosphorus, about 0.03% maximum sulfur, about 1.0% maximum silicon, about 12% to about 26% chromium, about 0.5% maximum nickel, 0.10% to 0.5% aluminum, 0.2% to 0.45% columbium, 0.03% maximum nitrogen, about 2% maximum copper, residual titanium, and balance essentially iron, with the sum of carbon plus nitrogen not exceeding 0.05%, and columbium present in excess of the amount required to react completely with carbon.

2. A ferritic stainless steel having high ductility and toughness in sections greater than about 3.2 mm in thickness, and good corrosion resistance in the heat affected zone of a weldment, said steel consisting essentially of, in weight percent, 0.02% maximum carbon, up to about 8% manganese, about 0.030% maximum phosphorus, about 0.03% maximum sulfur, about 0.5% maximum silicon, about 12% to about 18% chromium, about 4% maximum nickel, about 0.15% to about 0.4% aluminum, about 0.25% to about 0.40% columbium, about 0.025% maximum nitrogen, about 2% maximum copper, about 3% maximum molybdenum, about 0.05% maximum titanium, and balance essentially iron, with the sum of carbon plus nitrogen less than 0.04%, and columbium present in excess of the amount required to react completely with carbon.

3. The steel claimed in claim 1 or 2, wherein copper is restricted to a maximum of about 0.75%.

4. The steel claimed in claim 1 or 2, wherein aluminum is from 0.15% to about 0.25%.

5. The steel claimed in claim 2, wherein the sum total of aluminum and columbium is restricted to a maximum of about 0.60%.

6. The steel claimed in claim 2, in the form of hot reduced plate having a thickness greater than about 3.2 mm wich has been annealed at a temperature between about 900° and 1125° C.

7. The steel claimed in claim 2, in the form of hot reduced bar having a diameter of up to about 3.2 cm which has been annealed at a temperature between about 900° and 1125° C.

8. Sheet, strip, plate, bar, wire, castings and forgings having high ductility and toughness, and good corrosion resistance in the heat affected zone of a weldment, consisting essentially of, in weight percent, 0.03% maximum carbon, up to about 12% manganese, about 0.03% maximum phosphorus, about 0.03% maximum sulfur, about 1.0% maximum silicon, about 12% to about 26% chromium, about 0.5% maximum nickel, 0.10% to 0.5% aluminum, 0.2% to 0.45% columbium, 0.03% maximum nitrogen, about 2% maximum copper, residual titanium, and balance essentially iron, with the sum of carbon plus nitrogen not exceeding 0.05%, and columbium present in excess of the amount required to react completely with carbon.

* * * * *